US011131951B2

(12) United States Patent
Haim et al.

(10) Patent No.: US 11,131,951 B2
(45) Date of Patent: Sep. 28, 2021

(54) CONTROLLING VOLTAGE PROFILES

(71) Applicant: Hewlett-Packard Development Company, L.P., Spring, TX (US)

(72) Inventors: Moshe Haim, Nes Ziona (IL); Tsafrir Yedid Am, Nes Ziona (IL); Rivay Mor, Nes Ziona (IL); Iliya Shahamov, Nes Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/965,041

(22) PCT Filed: Mar. 28, 2018

(86) PCT No.: PCT/US2018/024938

§ 371 (c)(1),
(2) Date: Jul. 27, 2020

(87) PCT Pub. No.: WO2019/190509

PCT Pub. Date: Oct. 3, 2019

(65) Prior Publication Data

US 2021/0003956 A1 Jan. 7, 2021

(51) Int. Cl.
*G03G 15/00* (2006.01)

(52) U.S. Cl.
CPC ..... *G03G 15/5041* (2013.01)

(58) Field of Classification Search
None
See application file for complete search history.

(56) References Cited

U.S. PATENT DOCUMENTS

| | | | | |
|---|---|---|---|---|
| 4,839,722 | A | 6/1989 | Barry et al. | |
| 5,510,896 | A | 4/1996 | Wafler | |
| 7,414,752 | B2 | 8/2008 | Adam et al. | |
| 8,282,182 | B2 | 10/2012 | Chandu et al. | |
| 8,736,894 | B2 | 5/2014 | Kuo et al. | |
| 9,049,312 | B2 | 6/2015 | Liu et al. | |
| 2003/0099477 | A1 | 5/2003 | Shimmura | |
| 2006/0153585 | A1 | 7/2006 | Shin et al. | |
| 2008/0055666 | A1* | 3/2008 | Gila | H04N 1/6033 358/448 |
| 2010/0097657 | A1 | 4/2010 | Kuo et al. | |
| 2012/0237237 | A1 | 9/2012 | Hirai | |
| 2014/0211227 | A1* | 7/2014 | Yedid Am | H04N 1/506 358/1.13 |
| 2015/0212469 | A1 | 7/2015 | Dobbertin | |
| 2016/0342122 | A1* | 11/2016 | Parvin | G03G 15/065 |

* cited by examiner

*Primary Examiner* — Roy Y Yi
(74) *Attorney, Agent, or Firm* — Michael A Dryja

(57) ABSTRACT

In an example, a method includes printing a set of images by transferring print agent between a roller of a print agent source and an electrophotographic surface in a plurality of transfer operations, wherein the roller is controlled to have a first voltage profile during each of the transfer operations. A variation in optical density which is consistent across the set of printed images may be detected, and a second voltage profile correction may be determined based on the variation in optical density. The method may further comprise printing a subsequent image by transferring print agent between the print agent source roller and the electrophotographic surface in a subsequent transfer operation, wherein the roller is controlled to have the second voltage profile during the subsequent transfer operation.

15 Claims, 7 Drawing Sheets

CONTROLLING VOLTAGE PROFILES

BACKGROUND

In printing, print agents such as inks, toners, coatings and the like may be applied to a substrate. Substrates may in principle comprise any material, for example paper, card, plastics, fabrics or the like.

In some examples, the resulting printed output may be analysed in order to identify potential or actual defects. In some examples, a printed substrate is scanned, and the captured image is examined. In some examples, a printed output may be reviewed for internal color consistency. In some examples, a printed output may be compared to a reference image, for example an image which formed the basis of a print instruction, or a previously printed output which has been determined to meet certain criteria.

BRIEF DESCRIPTION OF DRAWINGS

Non-limiting examples will now be described with reference to the accompanying drawings, in which.

DETAILED DESCRIPTION

In some examples of print apparatus, a photo charging unit may deposit a substantially uniform static charge on an electrophotographic surface (also referred to as a photoconductor), for example a photo imaging plate, or 'PIP', which may be curved around the surface of a drum, and a write head dissipates the static charges in selected portions of the image area on the PIP to leave a latent electrostatic image. The latent electrostatic image is an electrostatic charge pattern representing the pattern to be printed. An electrostatic print agent composition may be transferred to the PIP from a print agent source, which may comprise a Binary Ink Developer (BID) unit, and which may present a film of the print agent to the PIP. A resin component of the print agent may be electrically charged by virtue of an appropriate potential applied to the print agent in the print agent source. The charged resin component, by virtue of an appropriate potential on the electrostatic image areas, may be attracted to the latent electrostatic image on the PIP. In general, it may be that the print agent does not adhere to the charged, non-image, areas and forms an image on the surface of the PIP. The electrophotographic surface will thereby acquire a developed print agent pattern on its surface.

In some examples of printing processes, a printed image may be analysed to detect defects therein. There are many potential sources of defects in an image, for example aging or failing print apparatus components, damaged or inappropriate substrates or coatings, inappropriate ink (or other print agent) compositions, a need to clean the apparatus, and the like. Thus, even if a user is made aware of a defect, it may not be clear what remedial action may be applied.

This can lead to wasted time in determining the source of a defect and, in the event of mis-diagnosis of the fault, inappropriate and potentially expensive maintenance operations.

During the printing process, ink can be applied in a non-uniform manner. This results in a non-uniform printed page. This non-uniformity can result from several sources including mechanical (e.g. mechanical recoil of cylinders) and electrical (e.g. non-uniform discharge of the electrophotographic surface). Color non-uniformity can, in some examples, appear prominent to a viewer in a printed output.

Figure 1:
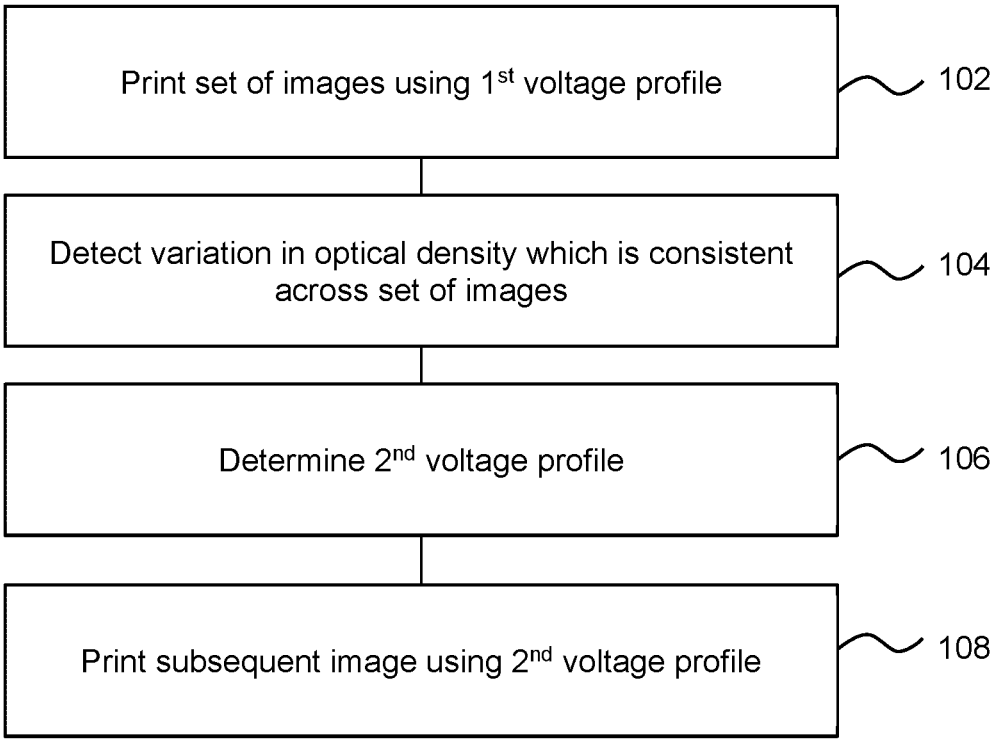
FIG. 1 is a flowchart of an example method of controlling a print apparatus roller voltage.

FIG. 1 is an example of a method, which may be a method for controlling a print apparatus roller voltage, in some examples to compensate for potential color non-uniformity.

Block 102 comprises printing a set of images by, for each image, transferring print agent between a roller of a print agent source and an electrophotographic surface in a print agent transfer operation, wherein the roller is controlled to have a (common) first voltage profile during each of the transfer operations. The roller of the print agent source may be a print agent transfer roller. The images may comprise at least one solid block of color. In some examples, all the images may be printed using the same print agent, e.g. the same color.

The voltage of the roller establishes the potential difference which transfers a film or layer of print agent from the print agent source to the electrophotographic surface. Varying the potential of the roller may change the thickness of the print agent film/layer. In some examples, the first voltage profile may comprise a fixed voltage. However, in other examples (for example in subsequent iterations of the method), the first voltage profile may vary during the transfer operation. By varying the voltage during a transfer of a film/layer of print agent, the local thickness of the film/layer in the direction of printing may be varied. In some examples, the direction of printing may be a direction parallel to a direction of transport of a printed image through a print apparatus. Considered another way, an image may have a leading edge, which is formed first, and a trailing edge, which is formed last. The leading edge may lead the trailing edge in the direction of printing.

The images may be presented on one substrate, or on a plurality of substrates. An image may comprise a 'separation', i.e. the result of transferring print agent to an electrophotographic surface, and thereafter to a substrate. To consider an example, there may be a printed substrate comprising a first stripe of yellow print agent in a first location and a second stripe of yellow print agent in a second location, wherein the stripes are formed parallel to the printing direction. It may be the case that the two stripes were formed as a single separation/image: a latent electrostatic image of the two stripes may be formed on a PIP, and a two stripe print agent pattern formed on the PIP may be transferred (in some examples via an intermediate transfer member) to a substrate. These stripes are formed as a single image/separation.

However, in other examples, the stripes may be formed separately, in two transfer operations to a PIP having a single stripe pattern in the electrostatic image, and therefore as two images/separations. In some examples, a first stripe may be transferred to an intermediate transfer member and remain thereon until the second stripe is also transferred to the intermediate transfer member, and the two stripes (the two separations/images) may be transferred to the substrate simultaneously. In other examples, the two separations may be applied to the substrate separately.

In the first case, the stripes printed in a single separation may show banding defects in the same location(s) in the direction of printing. However, in the second case, it is more likely that there may be a difference in the location of at least some banding artefacts, as the transfer roller and the electrophotographic surface are likely to be different sizes, so there is a variable phase difference, leading in turn to a change in the location of banding defects between separations resulting from an artefact caused by at least one of electrophotographic surface and the transfer roller, or by the interaction therebetween.

Block 104 comprises detecting a variation in optical density which is consistent across the set of printed images. The consistency may be a consistency in location. In some examples, the consistency may be a consistency in location in the dimension parallel to the direction of print. As will be set out in greater detail below, this may comprise determining an average, for example a mean, of optical density of a plurality of corresponding sampling lines in a plurality of images. In some examples, the average may comprise an average made up of optical density of a plurality of images/different separations. This serves to emphasise variations in optical density which are seen in multiple images/separation, and therefore identify consistent optical variations in optical density. This may in turn de-emphasise variations in optical density which shift between images, i.e. those which change locations in different separations/images. However, detecting variations in optical density which are consistent across the set of printed image may also comprise detecting variations in optical density which are shown in one image. In some examples therefore detecting a variation in optical density which is consistent across the set of printed images may comprise emphasising variations in optical density which are seen in multiple images/separation and/or de-emphasising variations in optical density which shift between images.

In some examples, block 104 may comprise detecting the variation in optical density by determining variation in the optical density of 'sampling lines' across each image, or a portion of each image, wherein the lines are orthogonal to a printing direction. This serves to emphasise variations in the direction of print. For example, an average optical density of corresponding sampling lines across a plurality of images (which may be corresponding in the sense that the sampling lines have a consistent offset from a leading edge) may be determined. The optical density of each sampling line, and/or of each 'average' sampling line, may be compared to a median optical density. Such 'average' sampling lines may provide a composite representation of the plurality of the printed image separations. In some examples, detecting a variation in optical density which is consistent across the set of printed images may comprise determining such a composite representation of the images.

In some examples, detecting variations in optical density may comprise detecting color consistency across an image (e.g. comparing a pixel or set of pixels at a first location in a printed image to a pixel/set of pixels in a second location, or to an average or representative value). In some examples, the image may be printed with instructions to produce a consistent color (e.g. a particular coverage level), and variations in color may be detected. In some examples, these variations are determined with reference to other image portions and/or data derived from the printed image (such as a median) and not with respect to an intended print outcome/print instructions. In some examples, a median color value may be determined, and the variation of each pixel, region or sampling line from the median may be determined.

In some examples, detecting variations in optical density may comprise identifying variations which have at least a threshold value. For example, the threshold value may be determined based on scanner noise. For example, sampling lines which are outside a threshold value of a median value for an image (or composite representation or "average" of the images) may be considered to have an optical density which is inconsistent with the intended image output and sampling lines which are within a threshold value of a median value for an image may be considered to have exhibit an acceptable optical density, i.e. an optical density which is consistent with an intended image output.

In one particular example, an image or a plurality of images may be printed on a substrate having a particular intended coverage, for example a 100% coverage, which is set to be the same for the image(s) in the print instructions. The image(s) may comprise at least one solid block of color.

In this example, sampling lines are defined across a substrate (and in some examples in corresponding locations of a plurality of substrates), wherein each sampling line has a different offset from the edge of the substrate. An average grey level of the image content along each sampling line is determined (noting that this may comprise contributions of different images), and a median of the average grey levels is determined. Each measured grey level for each line may be compared to the median and the percentage of lines which fall outside a predetermined margin (i.e. a threshold value) of the median may be identified. If the number of grey level values is below a threshold, a lack of color uniformity may be identified.

In some examples, each substrate may be considered in a plurality of segments, which run across the substrate (i.e. orthogonal to the direction of printing) and each comprise a plurality of sampling lines. There may be for example 3-10 segments on a substrate. For example, if 90% of the line values within a segment are within a predetermined range of the median, the segment may be considered to have color uniformity. If less than 90% of the line values within a segment are within the predetermined range of the median, color non-uniformity may be determined.

In other examples, the sampling line values for the image(s) may be considered as a whole rather than in segments.

In some examples, detecting variations in optical density may comprise comparing the scanned image to reference image data, for example on a pixel by pixel, or patch by patch, basis. Reference image data may for example comprise the image data used to determine the print instructions to print the printed substrate, or may be based on a previously printed image (which may for example have been reviewed and determined to be satisfactory). In other examples, the analysis may be carried out according to some other predetermined criteria.

In some examples, if there is no color non-uniformity detected, the method may terminate.

Block 106 comprises determining a second voltage profile based on the variation in optical density. In some examples, this may comprise determining a voltage profile correction. For example, where optical density in the printing direction is consistently lower than the average (e.g. the median) for the set of images printed using the first voltage profile, the voltage profile correction may indicate an increase in a potential difference between the print agent source roller and the electrophotographic surface at that point in the transfer cycle. Conversely, where the optical density in the printing direction is consistently higher than the average (e.g. the median) for the set of images printed using the first voltage profile, the voltage profile correction may indicate a decrease in a potential difference between the print agent source roller and the electrophotographic surface at that point in the transfer cycle. The size of the correction may relate to the size of the variation in optical density, and may for example be defined algorithmically, or recorded in a lookup table, or the like.

Such a voltage profile correction may be applied to the first voltage profile to determine a second voltage profile. In some examples, the second voltage profile may be a varying voltage profile. In other words, the voltage of the roller may vary while transferring a film or layer to the electrophotographic surface to print a single image.

Block 108 comprises printing a subsequent image by transferring print agent between the print agent source roller and the electrophotographic surface in a subsequent transfer operation, wherein the roller is controlled to have the second voltage profile during the subsequent transfer operation.

Generally, the voltage may be varied effectively in the direction of printing but not in a direction orthogonal thereto. Thus, by emphasising variations in the optical density which are seen in the direction of printing (as described in relation to block 104 above), those variations which may be compensated for by changing the voltage of a roller may be identified.

Figure 2A:
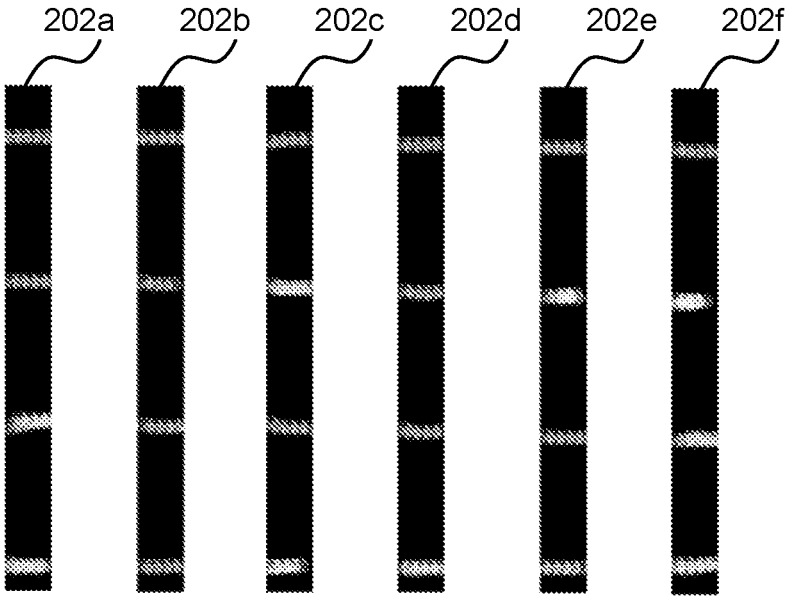
FIGS. 2A-C show, respectively, a schematic representation of a plurality of example printed stripes of a single image, a graph of the grey level of a plurality of sampling lines of each example stripe, and a graph of the average of the grey level of the sampling lines.

FIG. 2A shows an example of a plurality of stripes 202*a-f* of a single print agent on a substrate. In this example, the stripes 202 are part of the same separation/image, and thus the banding effects appear in the same location down the page.

Figure 2B:
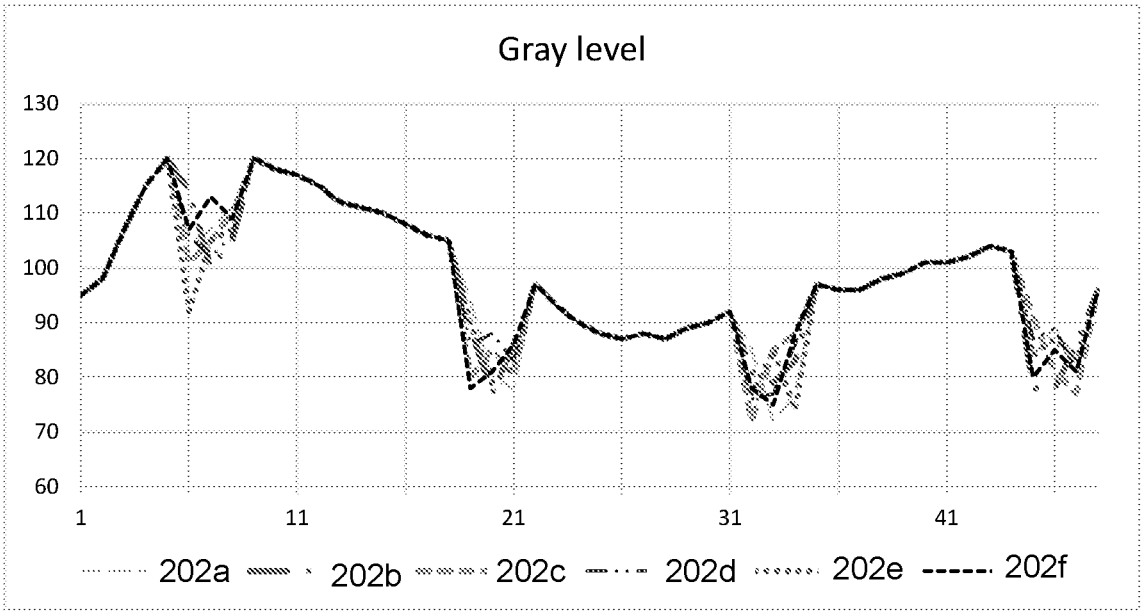

FIG. 2B shows a plot of the grey level of each stripe 202 in each of a plurality of sampling lines (identified by an offset from the leading edge in centimetres) taken in a direction orthogonal to the length of the stripes and the direction of printing. This shows the variations in optical density of the image. It may be noted in this example that the optical density of the lines of each stripe (or image portion) is considered separately, even though the stripes comprise part of the same image. This shows some 'dips' associated with the variations, but it may also be seen that there is an underlying variation or curve.

Figure 2C:
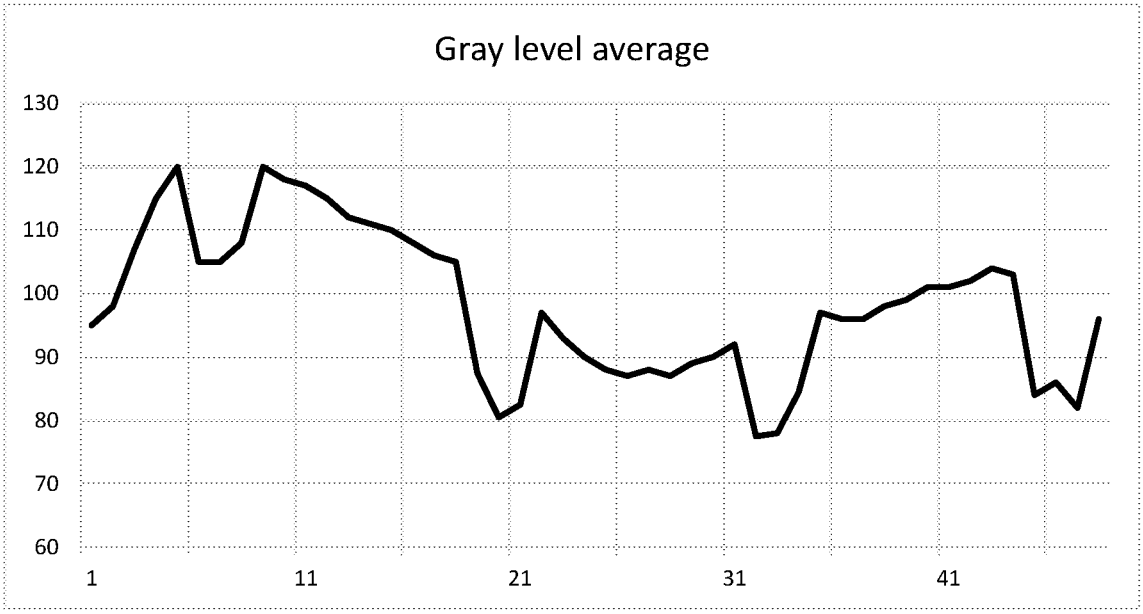

FIG. 2C shows an average of the results, in which the banding is clear. However, as different images may result in a shift of the position of the banding, the method proposes considering a plurality of images, which may assist in identifying variations in optical density which are consistent between the images and therefore may be addressed by controlling the voltage of the roller.

Figure 3A:
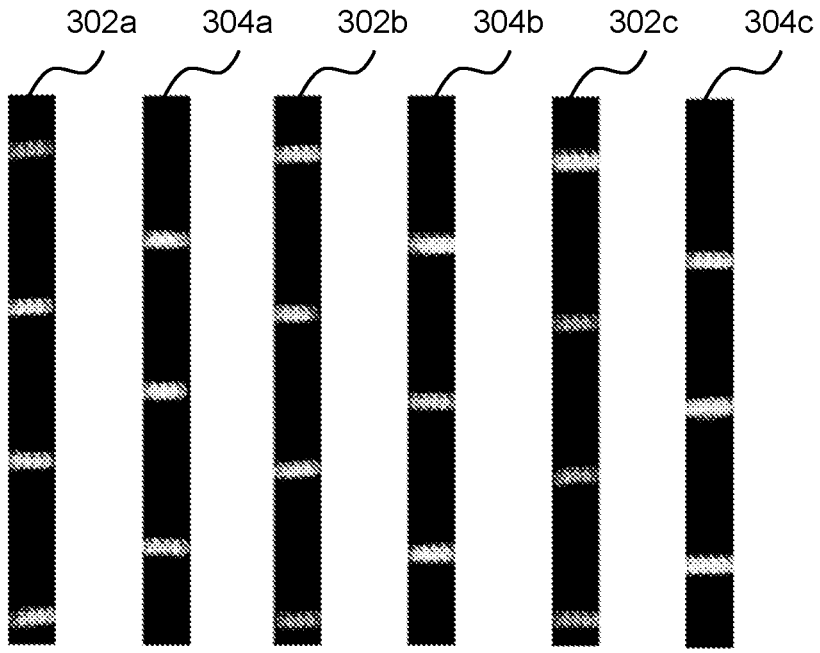
FIGS. 3A-C show, respectively, a schematic representation of a plurality of example printed stripes of two images, a graph of the grey level of a plurality of sampling lines of each example stripe, and a graph of the average of the gray level of the sampling lines.

FIG. 3A shows a second plurality of stripes. In this example, stripes 302*a-c* are printed in a first separation (image) and stripes 304*a-c* are printed in a second separation (image). The stripes of different separations in this example are interleaved to obtain a full sampling across the width of the roller and electrophotographic surface. Both the first and the second separations show banding, but this is not in the same place on the page between the two separations. Interleaving the stripes in this way allows a plurality of images to be measured on a single substrate, thus conserving resources.

Figure 3B:
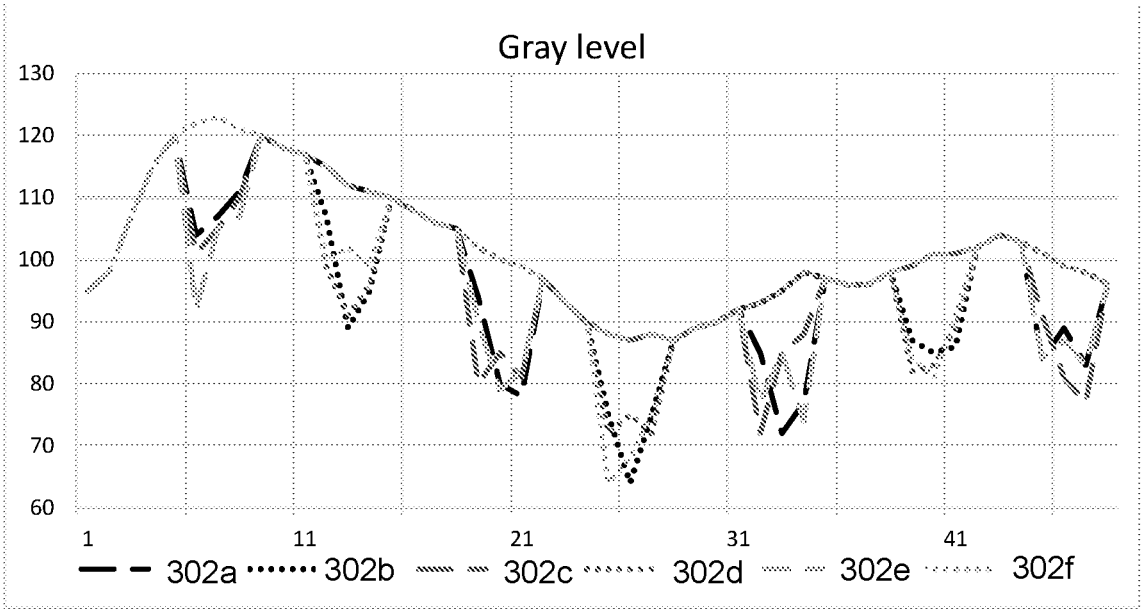
Figure 3C:
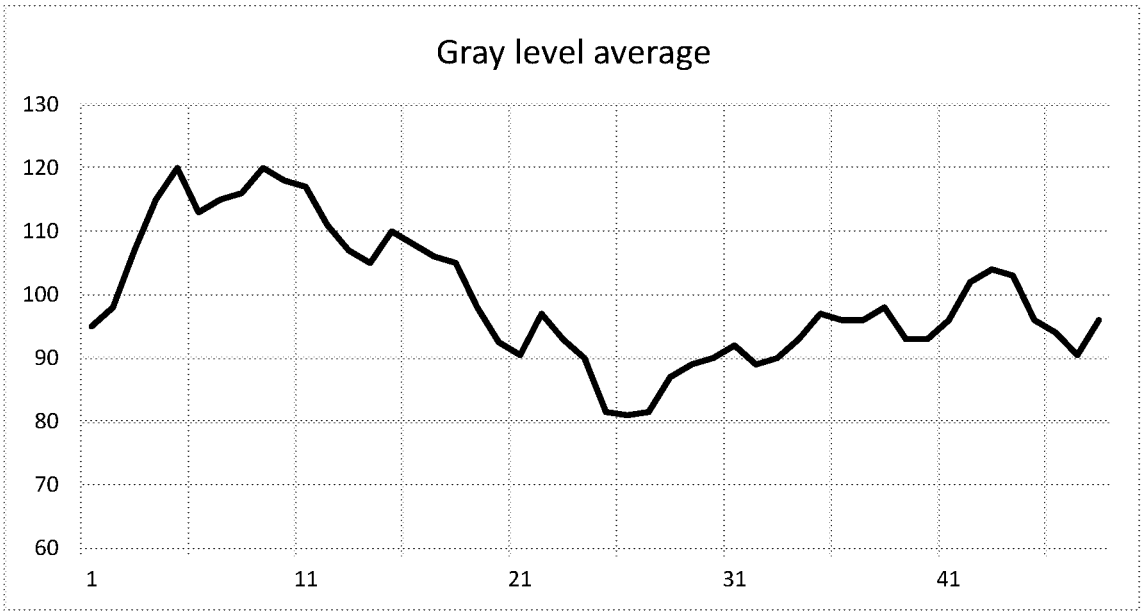

FIG. 3B shows a plot of grey levels similar to that shown in FIG. 2B. It may be noted in this example that the optical density of the lines of each stripe (image portion) is considered separately, even when the stripes comprise part of the same image. FIG. 3C shows an average of the results, similar to that shown in FIG. 2C. Here, the underlying trend which is common to both separations is more readily apparent.

This average plot in FIG. 3C (which may be considered to be a composite representation of the set of images) may be analysed to determine if color non-uniformity exists. For example, and as described in relation to block 104 above, this may comprise determining a median and further determining if at least a predetermined number of the sampling lines (in some examples, the lines in a particular segment of the printed output) are within a predetermined margin of the median, as discussed above.

Figure 4:
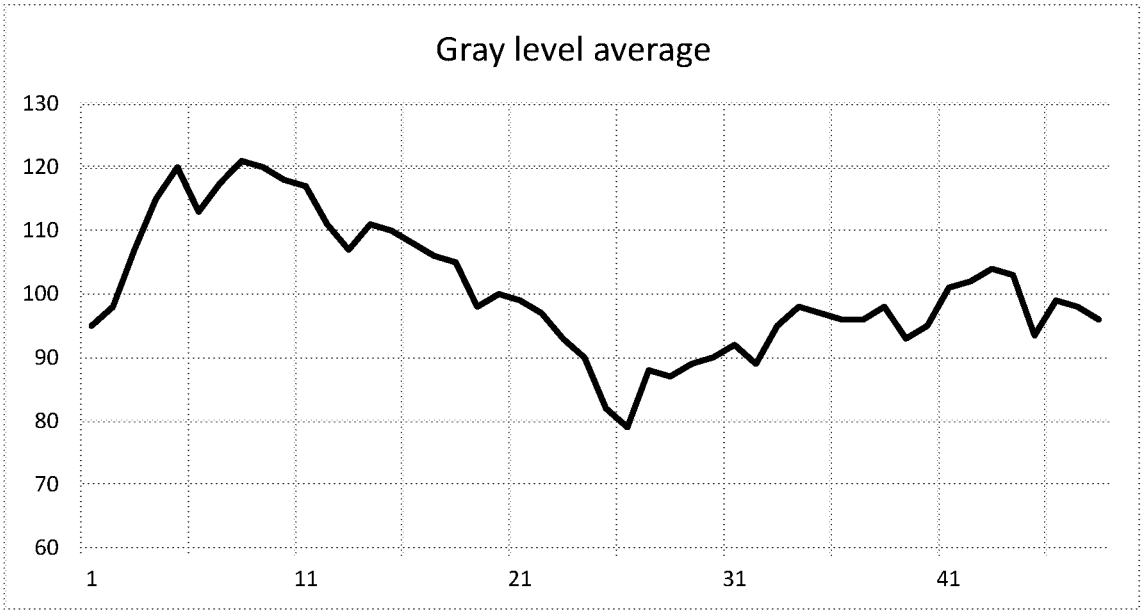
FIG. 4 is a graph showing average grey levels of sampling lines for three different images.

FIG. 4 shows an average for two stripes each of three different separations (images). The 'dips' associated with banding are further de-emphasised, and the underlying trend (the variation in optical density which is consistent within the set of images) is more readily apparent.

In further examples, there may be more separations (or images formed in a single transfer operation) and/or more samples/images portions (e.g. stripes) within a separation. The separations may be printed on one or more substrates.

In other words, in order to determine which variations in optical density can be corrected or compensated for by changing a voltage profile, the method of FIG. 1 proposes determining which of the variations are consistent over a set of images (or separations). Defects in an image which may move between images/separations are de-emphasised (and may in some examples be corrected for in some other way, for example by cleaning or the like, or may simply resolve over time). Therefore, rather than carry out a complex analysis of the relative phases of the components of the printing apparatus, the variations in optical density which can be compensated for by controlling the voltage of the roller may be addressed.

It may be noted that it may or may not be the case that the origin of the consistent changes in optical density is associated with the roller itself: they may for example arise due to variation in charge across the photoconductive surface, or the source may be undetermined. However, the issues may nevertheless be addressed by setting an appropriate second voltage profile.

In some examples, the method may be iterated. For example, this may comprise detecting a variation in optical density which is consistent across a set of subsequent printed images printed using the second voltage profile. A voltage profile correction may be determined based on the variation in optical density, and the further voltage profile correction may be applied to the second voltage profile to determine a third voltage profile. At least one further subsequent image may be printed by transferring print agent between the print agent source roller and the electrophotographic surface, wherein the roller is controlled to have the third voltage profile.

In some examples, the method may be carried out for a plurality of different print agents. In such examples, the method may comprise selecting a first print agent and carrying out the method of FIG. 1 with respect to the first print agent. The method may further comprise selecting a second print agent and carrying out the method with respect to the second print agent.

Figure 5:
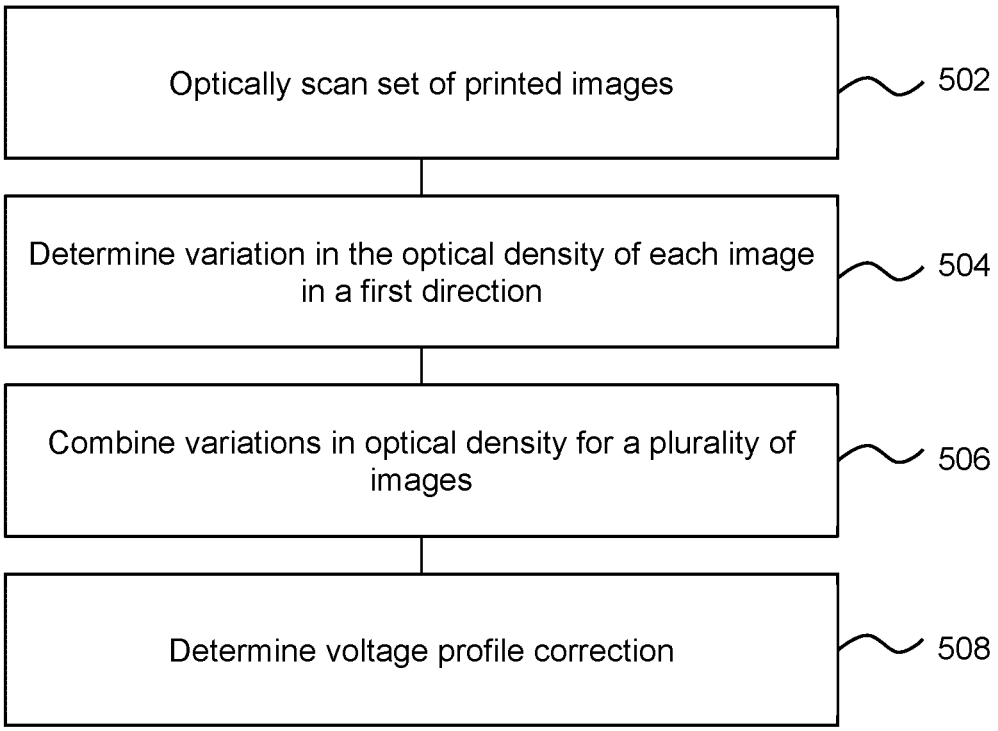
FIG. 5 is a flowchart of a further example method of controlling a print apparatus roller voltage.

FIG. 5 is an example of a method, which may comprise a method of carrying out block 104.

Block 502 comprises optically scanning a set of printed images, in this example using an 'in-line scanner', which is integrated into a print apparatus. This may comprise scanning one substrate or a plurality of substrates. In other examples, the scanned image may be acquired from a memory, which may be local or remote, and/or may be received over a network, or the like. Block 504 comprises, for each image, determining a variation in the optical density of that image. For example, this may comprise determining the optical density of a plurality of sampling lines of the image, which are orthogonal to the direction of printing. In some examples, the optical density of the sampling lines may be compared to a median optical density value for an image/printed output.

Block 506 comprises combining the variations in optical density of a plurality of images. In some examples, an average may be determined, although in other examples some other measure (e.g. a sum) may be determined. Block 508 comprises determining a voltage profile correction, for example by use of a look-up table.

Figure 6A:
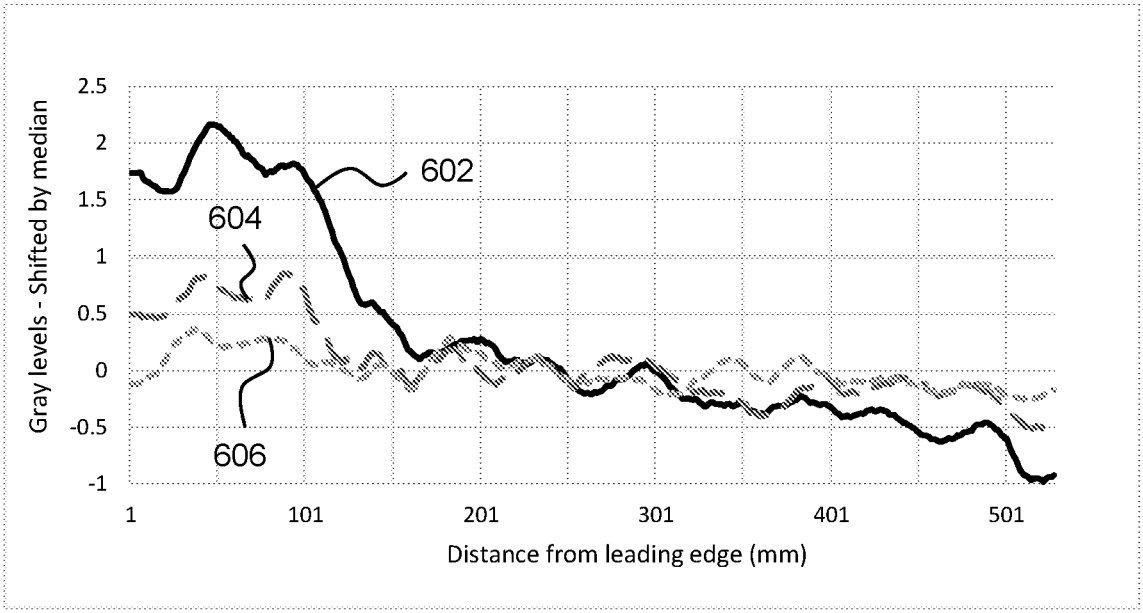
FIGS. 6A-B are graphs showing, respectively color uniformity and voltage corrections.

FIG. 6A shows the color uniformity in the direction of print in an initial set of images printed using a first voltage profile (line 602, which in this example is the voltage profile before any correction is applied), the color uniformity in the direction of print in a second set of images printed using a second voltage profile determined using the method of FIG. 1 (line 604), and the color uniformity in the direction of print in a third set of images printed using a third voltage profile determined by applying the method of FIG. 1 to the second set of images (line 606). In this example, the grey level of each of a plurality of composite sampling lines (where each composite sampling line may be an average of sampling lines across one or more samples (e.g. image portions such as stripes) from a plurality of images) may be is compared to a median value, which may for example be the median of the grey levels of the sampling lines shown in the averaged data of FIGS. 3C and 4 above. As can be seen, the lines 602, 604, 606 become progressively more level, indicating an increase in the color uniformity.

In this example, the x-axis is in units of millimetres, as opposed to centimetres, as was used for FIGS. 2A-C, 3A-C and 4.

Figure 6B:
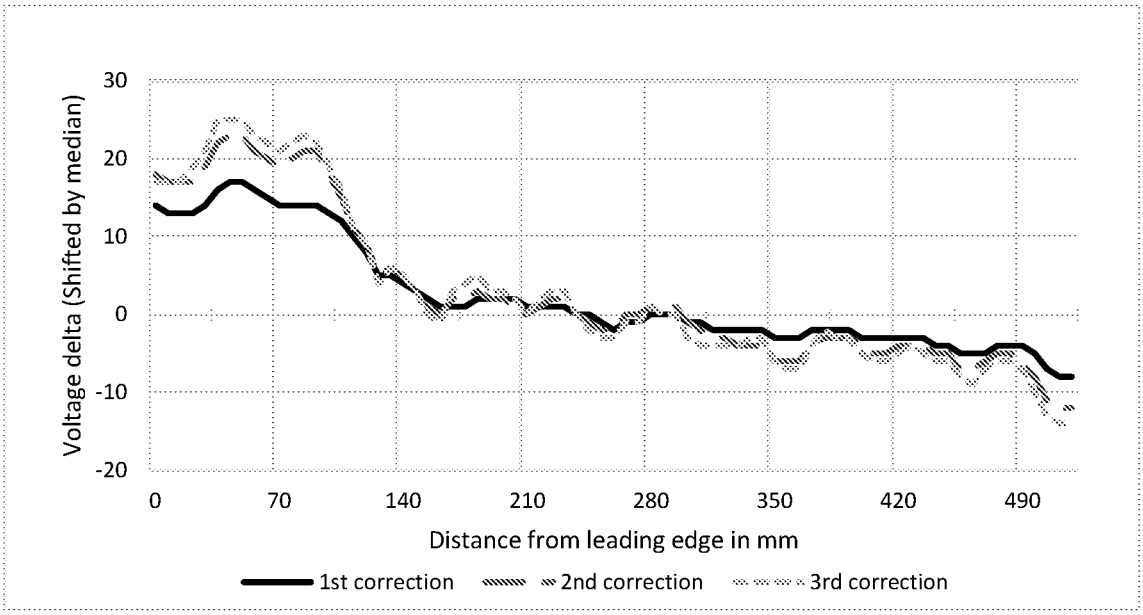

FIG. 6B shows determined first, second and third voltage corrections (which are applied to a baseline voltage) to apply during transfer operations, wherein the shift is relative to a median voltage.

Figure 7:
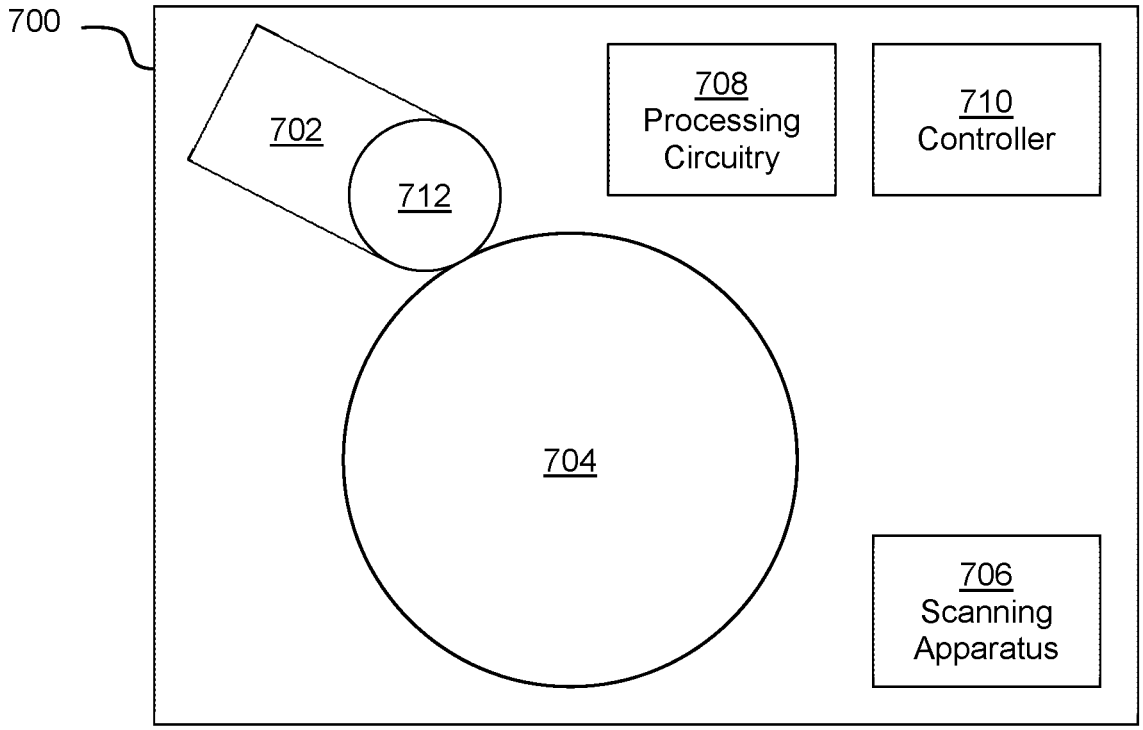
FIG. 7 is an example of a print apparatus.

FIG. 7 is an example of a print apparatus 700 comprising a print agent source 702, an electrophotographic surface 704, scanning apparatus 706, processing circuitry 708 and a controller 710.

The print agent source 702 comprises a print agent transfer roller 712 having a controllable voltage. For example, the print agent source 702 may comprise a chargeable surface which is controllable so as to result in a variable voltage difference to a ground voltage.

In use of the apparatus 700, the electrophotographic surface 704 receives print agent from the print agent transfer roller 712 to form an image separation as described above. The separation may comprise print agent from a single print agent source.

The scanning apparatus 706 scans a printed image separation. In some examples, the scanning apparatus 706 is operable to scan a plurality of printed images (which may be printed on one or more substrates) and may be any scanning apparatus suited to the purpose of capturing images of printed pages.

The processing circuitry 708 operates to acquire an optical scan of a plurality of printed image separations from the scanning apparatus 706, determine if there is a variation in optical density in a composite representation of the plurality of the printed image separations (for example, this may comprise an 'average' of one or more images, or one or more samples (e.g. stripes) taken from one or more images) and, if so, determine a corrected voltage profile for the print agent transfer roller based on the variation in optical density. This may for example comprise a correction to the voltage profile for the print agent transfer roller used to print the images.

The processing circuitry 708 may cause the controller 710 to control the voltage of the print agent transfer roller 712 to have the corrected voltage profile when printing a subsequent image separation.

In some examples, the processing circuitry 708 may carry out at least one block of FIG. 1 or FIG. 5.

In some examples, the print apparatus 700 is a Liquid Electro Photographic (LEP) printing apparatus which may be used to print a print agent such as an electrostatic ink composition (or more generally, an electronic ink). In such examples, a photo charging unit may deposit a substantially uniform static charge on the electrophotographic surface 702, which may be a photo imaging plate, or 'PIP', and a write head (not shown) dissipates the static charges in selected portions of the image area on the PIP to leave a latent electrostatic image over. The latent electrostatic image is an electrostatic charge pattern representing the pattern to be printed. The electrostatic ink composition is then transferred to the PIP from the print agent source 702, which may comprise a print agent application unit such as a Binary Ink Developer (BID) unit, and which may present a film of the print agent to the PIP. A resin component of the print agent may be electrically charged by virtue of an appropriate potential applied to the print agent in the print agent source 702. The charged resin component, by virtue of an appropriate potential on the electrostatic image areas, is attracted to the latent electrostatic image on the PIP. The print agent does not adhere to the charged, non-image areas and forms an image on the surface of the latent electrostatic image. The electrophotographic surface 702 will thereby acquire a developed print agent electrostatic ink composition pattern on its surface.

The pattern may then be transferred to an intermediate transfer member, for example by pressure and/or virtue of an appropriate potential applied between the photoconductor and the intermediate transfer member such that the charged print agent is attracted to the intermediate transfer member. The print agent pattern may then be dried and fused on the intermediate transfer member before being transferred to a print media sheet (for example, adhering to the colder surface thereof). In some examples, the intermediate transfer member is heated.

In other examples, the print apparatus 700 may comprise a different form of print apparatus.

Figure 8:
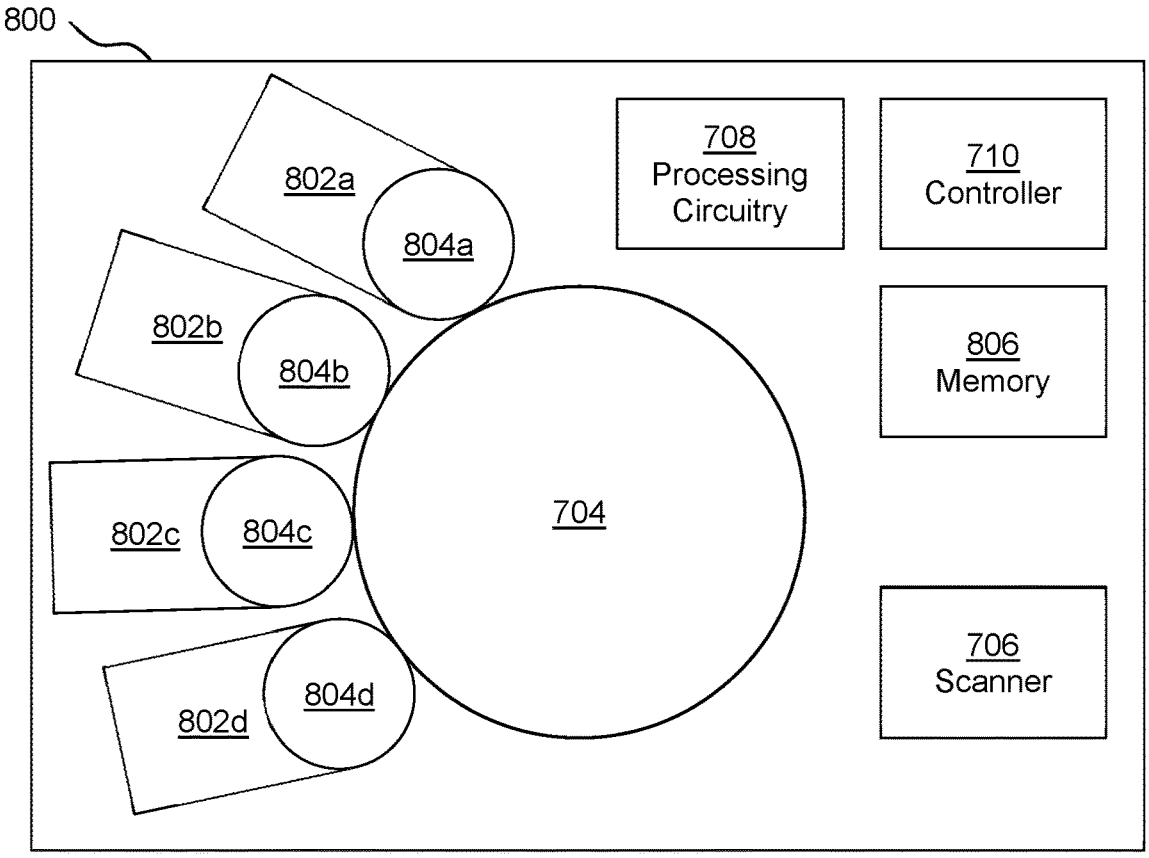
FIG. 8 is a further example of a print apparatus.

FIG. 8 is an example of a print apparatus 800, which comprises the components of the print apparatus 700, but in this example there are a plurality of print agent sources 802*a-d*, each comprising respective print agent transfer rollers 804*a-d* having controllable voltages. In this example the processing circuitry 708 is operable to determine corrected voltage profile(s) for each print agent source 802 for which there is a variation in optical density which is consistent across a plurality of printed image separations of that print agent source and/or present in a composite representation. The corrected voltage profiles may be determined independently of one another.

The print apparatus 800 further comprises a memory 806, which stores a look-up table associating variations in optical density with voltage corrections, wherein the processing circuitry 708 is to determine the correction(s) to the voltage profile(s) by accessing the look-up table.

Figure 9:
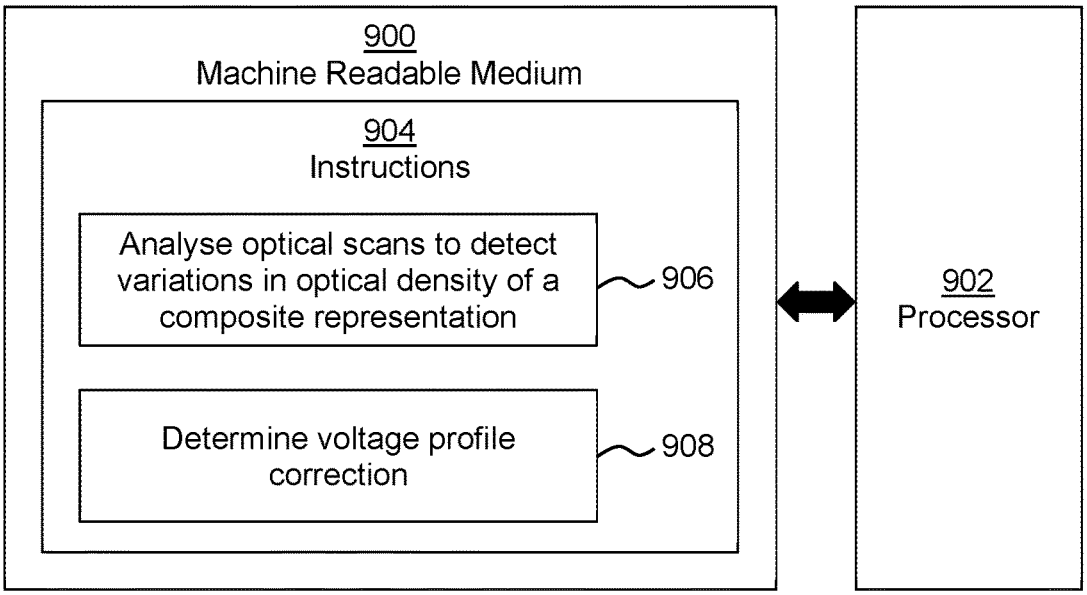
FIG. 9 is an example of a machine readable medium in association with a processor.

FIG. 9 is an example of a tangible machine readable medium 900 in association with a processor 902. The machine readable medium 900 comprises non-transitory instructions 904 which, when executed by the processor 902, cause the processor 902 to carry out processes. The instructions 904 comprise instructions 906 to cause the processor 902 to analyse a set of optical scans of printed image separations printed from a first print agent application unit to detect variations in optical density in a composite representation of the plurality of the printed image separations and comprise instructions 908 to cause the processor 902 to determine a voltage profile correction to a print agent transfer voltage profile used in printing image separations of the first print agent application unit.

In some examples, the instructions 904 comprise instructions to cause the processor 902 to analyse the set of optical scans of printed images comprise instructions to divide each image into a plurality of sampling lines, and to detect variations in optical density of the sampling lines.

In some examples, the instructions 904 comprise instructions to cause the processor 902 to iterate the image analysis and the voltage profile correction, for example until the consistent variations in optical density are resolved. For example, this may be when the number or proportion of sampling lines which are associated with a grey level value which is outside of a predetermined range of the median grey level value is below a threshold.

In some examples, the instructions 904, 906, 908 may carry out at least one block of FIGS. 1 and/or 5. In some examples, the instructions 904, 906, 908 may provide at least part of the processing circuitry 708 described above.

Aspects of some examples in the present disclosure can be provided as methods, systems or machine readable instructions, such as any combination of software, hardware, firmware or the like. Such machine readable instructions may be included on a computer readable storage medium (including but not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least one flow in the flow charts, as well as combinations of the flows in the flow charts can be realized by machine readable instructions.

The machine readable instructions may, for example, be executed by a general purpose computer, a special purpose computer, an embedded processor or processors of other programmable data processing devices to realize the functions described in the description and diagrams, and which may for example comprise at least part of the processing circuitry 708. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims and/or with any other dependent claim(s).

The invention claimed is:

1. A method comprising:

printing a set of images by transferring print agent between a roller of a print agent source and an electrophotographic surface in a plurality of transfer operations, wherein the roller is controlled to have a first voltage profile during each of the transfer operations;

optically scanning the set of printed images;

detecting, based on the optically scanned set of printed images, a variation in optical density which is consistent across the set of printed images;

determining a second voltage profile based on the detected variation in optical density; and printing a subsequent image by transferring print agent between the print agent source roller and the electrophotographic surface in a subsequent transfer operation, wherein the roller is controlled to have the second voltage profile during the subsequent transfer operation.

2. A method according to claim 1, wherein detecting the variation in optical density which is present in a plurality of the printed images comprises:

for each image, determining at least one variation in optical density of that image; and combining the variations in optical density of the plurality of images.

3. A method according to claim 1 wherein detecting the variation in optical density comprises determining the optical density of each of a plurality of sampling lines within the printed images, wherein the lines are orthogonal to a printing direction.

4. A method according to claim 1, wherein detecting the variation in optical density which is present in a plurality of the printed images comprises:

optically scanning the set of images using an in-line scanner.

5. A method according to claim 1, wherein the second voltage profile comprises a varying voltage profile.

6. A method according to claim 1 comprising determining a voltage profile correction based on the variation in optical density; and applying the voltage profile correction to the first voltage profile to determine the second voltage profile.

7. A method according to claim 1 further comprising:

printing a second set of images by transferring print agent between a roller of a print agent source and an electrophotographic surface in a plurality of transfer operations, wherein the roller is controlled to have the second voltage profile during each of the transfer operations;

detecting a variation in optical density which is consistent across the second set of printed images;

determining a third voltage profile based on the variation in optical density;

printing a further subsequent image by transferring print agent between the print agent source roller and the electrophotographic surface, wherein the roller is controlled to have the third voltage profile during the transfer operation.

8. A method according to claim 1 which comprises:

selecting a first print agent;

carrying out the method with respect to the first print agent;

selecting a second print agent; and carrying out the method with respect to the second print agent.

9. Print apparatus comprising:

a print agent source comprising a print agent transfer roller having a controllable voltage;

an electrophotographic surface to receive print agent from the print agent transfer roller to form an image separation;

scanning apparatus to scan a printed image separation;

a controller; and processing circuitry, wherein the processing circuitry is:

to acquire an optical scan of a plurality of printed image separations from the scanning apparatus, to determine, based on the optical scan of the plurality of printed image separations, if there is a variation in optical density in a composite representation of the plurality of the printed image separations, and, if so, to determine a corrected voltage profile for the print agent transfer roller based on the determined variation in optical density; and the controller is to control the print agent transfer roller to have the corrected voltage profile when printing a subsequent image separation.

10. Print apparatus according to claim 9 comprising:

a plurality of print agent sources comprising respective print agent transfer rollers having controllable voltages, and wherein the processing circuitry is to determine corrected voltage profiles for each print agent source.

11. Print apparatus according to claim 9 further comprising a memory, the memory storing a look-up table associating variations in optical density with voltage corrections, wherein the processing circuitry is to determine the corrected voltage profile by accessing the look-up table.

12. Print apparatus according to claim 9 wherein the processing circuitry is to determine if there is a variation in optical density by determining an optical density of each of a plurality of sampling lines of the plurality of the printed images, wherein the sampling lines are orthogonal to a print direction.

13. A tangible machine readable medium storing instructions which when executed by a processor cause the processor to:

analyze a set of optical scans of printed image separations printed from a first print agent application unit to detect variations in optical density in a composite representation of the printed image separations; and determine a voltage profile correction to a print agent transfer voltage profile used in printing the printed image separations of the first print agent application unit.

14. A tangible machine readable medium according to claim 13 wherein the instructions to analyze the set of optical scans of printed image separations comprise instructions to divide each image into a plurality of sampling lines, and to detect variations in optical density of the lines.

15. A tangible machine readable medium according to claim 13 further storing instructions to iterate the optical scan analysis and the voltage profile correction.

* * * * *